US006520077B1

(12) United States Patent
Minagawa et al.

(10) Patent No.: US 6,520,077 B1
(45) Date of Patent: Feb. 18, 2003

(54) SCREW PRESS

(75) Inventors: Takaki Minagawa, Sagamihara (JP); Yasuhiko Oyamada, Sagamihara (JP); Kunihiro Suzuki, Sagamihara (JP); Youichi Kubota, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 77 days.

(21) Appl. No.: 09/696,550

(22) Filed: Oct. 25, 2000

(30) Foreign Application Priority Data

| | | |
|---|---|---|
| Dec. 10, 1999 | (JP) | 11-350900 |
| Mar. 31, 2000 | (JP) | 11-090507 |
| Jun. 24, 2000 | (JP) | 11-178003 |

(51) Int. Cl.[7] ..... B30B 1/18

(52) U.S. Cl. ..... 100/289; 100/99; 100/48; 100/270; 100/43; 72/454; 72/20.2

(58) Field of Search ..... 100/43, 289, 935, 100/270, 48, 99; 72/454, 20.2

(56) References Cited

U.S. PATENT DOCUMENTS

| | | | | | |
|---|---|---|---|---|---|
| 4,480,538 | A | * | 11/1984 | Yoshida | 100/282 |
| 4,782,749 | A | * | 11/1988 | Iwasaki et al. | 100/271 |
| 5,289,096 | A | * | 2/1994 | Takeda | 100/289 |
| 5,720,988 | A | * | 2/1998 | Yoneda | 100/257 |
| 5,813,322 | A | * | 9/1998 | Kuroda | 100/231 |
| 5,921,125 | A | * | 7/1999 | Inoue et al. | 72/20.2 |
| 6,128,987 | A | * | 10/2000 | Nakagawa et al. | 100/269.14 |

FOREIGN PATENT DOCUMENTS

| | | | | | |
|---|---|---|---|---|---|
| EP | 0943422 | | | 9/1999 | B30B/15/14 |
| GB | 1480079 | | | 7/1977 | B30B/15/14 |
| JP | 62252700 | A | * | 11/1987 | 100/43 |
| JP | 62296999 | A | * | 12/1987 | 100/48 |
| JP | 03106599 | A | * | 5/1991 | 100/99 |
| JP | 07 009200 | | | 1/1995 | B30B/15/14 |
| JP | 10 272600 | | | 10/1998 | B30B/15/14 |
| JP | 10 277796 | | | 10/1998 | B30B/15/14 |
| JP | 10277798 | | | 10/1998 | B30B/15/14 |
| JP | 10 277799 | | | 10/1998 | B30B/15/14 |
| JP | 11207536 | A | * | 8/1999 | |
| JP | 2000210795 | A | * | 8/2000 | |
| JP | 2000280100 | | | 10/2000 | B30B/15/14 |

* cited by examiner

*Primary Examiner*—Allen Ostrager
*Assistant Examiner*—Jimmy Nguyen
(74) *Attorney, Agent, or Firm*—Darby & Darby

(57) ABSTRACT

A screw press which can ensure the positional precision of the ram when the rotation amount of the press motor does not directly translate into the position of the ram because there is other machinery, such as a decelerator and the like, present between the motor (servo motor) and the screw mechanism, has a construction in which a position detection sensor, which detects the position of the ram, is provided, and the position of the ram is controlled by the output from this sensor.

3 Claims, 4 Drawing Sheets

SCREW PRESS

BACKGROUND TO THE INVENTION

The present invention relates to a screw press. A screw press is a press machine which has a servo motor as the driving source and raises and lowers a ram (a slide) by a screw mechanism.

U.S. Pat. No. 2,533,486 is an example of the prior art. In the patent publication for this prior art example, there is described a construction in which an electric motor is the drive source and a ram is raised and lowered via a screw mechanism. The position and speed and the like of the ram are controlled using pulses from an encoder which is provided on the motor.

Referring to FIG. 5, this prior art is shown. A screw shaft 7*a* is connected to the output shaft of a motor (servo motor) 2. An end of screw shaft 7*a* is screwed into a nut 8*a* of a ram 8. When servo motor 2 rotates in the direction of arrow B, ram 8 is raised and lowered in the direction of arrow A due to the action of a screw mechanism 7. In other words, when there is positive rotation and reverse rotation of servo motor 2, ram 8 has a reciprocating motion due to the action of the screw mechanism. In this situation, because the screw shaft is provided perpendicularly, ram 8 has a rise and fall motion.

An upper mold (not shown) is affixed to ram 8. Opposite this, a lower mold is affixed to a bolster. Material supplied between these upper and lower molds is pressed.

As described previously, an encoder 3 is provided on servo motor 2. There is feed back of the pulse signals of encoder 3 to a position control circuit and a speed control circuit, and the position and speed of ram 8 are controlled.

Because the rotation amount of servo motor 2 is detected by encoder 3, the amount of raising or lowering of ram 8, or, in other words, the position of ram 8, can be controlled by the pulse number from encoder 3. Furthermore, the speed of ram 8 can be controlled by the pulse number per unit time of encoder 3.

In the same figure, processing of data, such as inputting, establishing, changing, and the like of data such as the position, speed, and the like of the ram, is conducted by the information processing control circuit. By matching the pulse of encoder 3 with a position and speed of ram 8 which have been established beforehand, the position and speed of ram 8 can be controlled.

The above control system is called a semi-closed loop system. All of the control of the ram is conducted by the pulses of the encoder. There are no means for feedback of the actual movement conditions of the ram. As a result, in this prior art example, in order to have a high precision position control of the ram, there is direct coupling of the motor, which is the driving source, and the screw mechanism. There are no devices interposed between them. Such devices can obstruct the precision of the ram position because of deformation or loosening.

Stated differently, in the semi-closed loop system of the prior art example, because there is no construction for feedback of the actual positional information of the ram, if any machinery is placed between the motor and the screw mechanism, the rotation amount of the motor does not directly translate into the position of the ram, and the desired positional precision for the ram is not achieved.

OBJECT AND SUMMARY OF THE INVENTION

The object of the present invention is to provide a screw press which can ensure the positional precision of the ram when the rotation amount of the above motor does not directly translate into the position of the ram because there is other machinery, such as a decelerator and the like, present between the motor (servo motor) and the screw mechanism.

The present invention has a construction in which a position detection sensor, which detects the position of the ram, is provided, and the position of the ram is controlled by the output from this sensor. The invention is directed to a screw press, in which a ram is driven by a servo motor via a screw mechanism, wherein a position detection sensor, which detects the position of a ram, is interposed between either a frame or a bolster and the ram; output from the position detection sensor is used in positional control of the ram; the position in the vertical direction of the positional sensor is near the lower surface of the ram. In addition, the invention provides a screw press, wherein: with respect to the value of the bottom dead center which has been established beforehand, an in-position value in which the ram is considered to have reached the bottom dead center is provided, and the in-position value can be freely adjusted. In addition, the screw press is one wherein: in the vicinity of a plurality of points specifying ram positions which have been established beforehand, the variability for the control can be adjusted for each of the plurality of points by a timer. Among the plurality of points established beforehand, for each point except the bottom dead center, there are in-position values, with respect to positional data which have been established beforehand, in which the ram is considered to have reached each of the plurality of points, and the in-position values can be adjusted freely.

The above, and other objects, features and advantages of the present invention will become apparent from the following description read in conjunction with the accompanying drawings, in which like reference numerals designate the same elements.

DETAILED DESCRIPTION OF THE EMBODIMENTS

Figure 1:
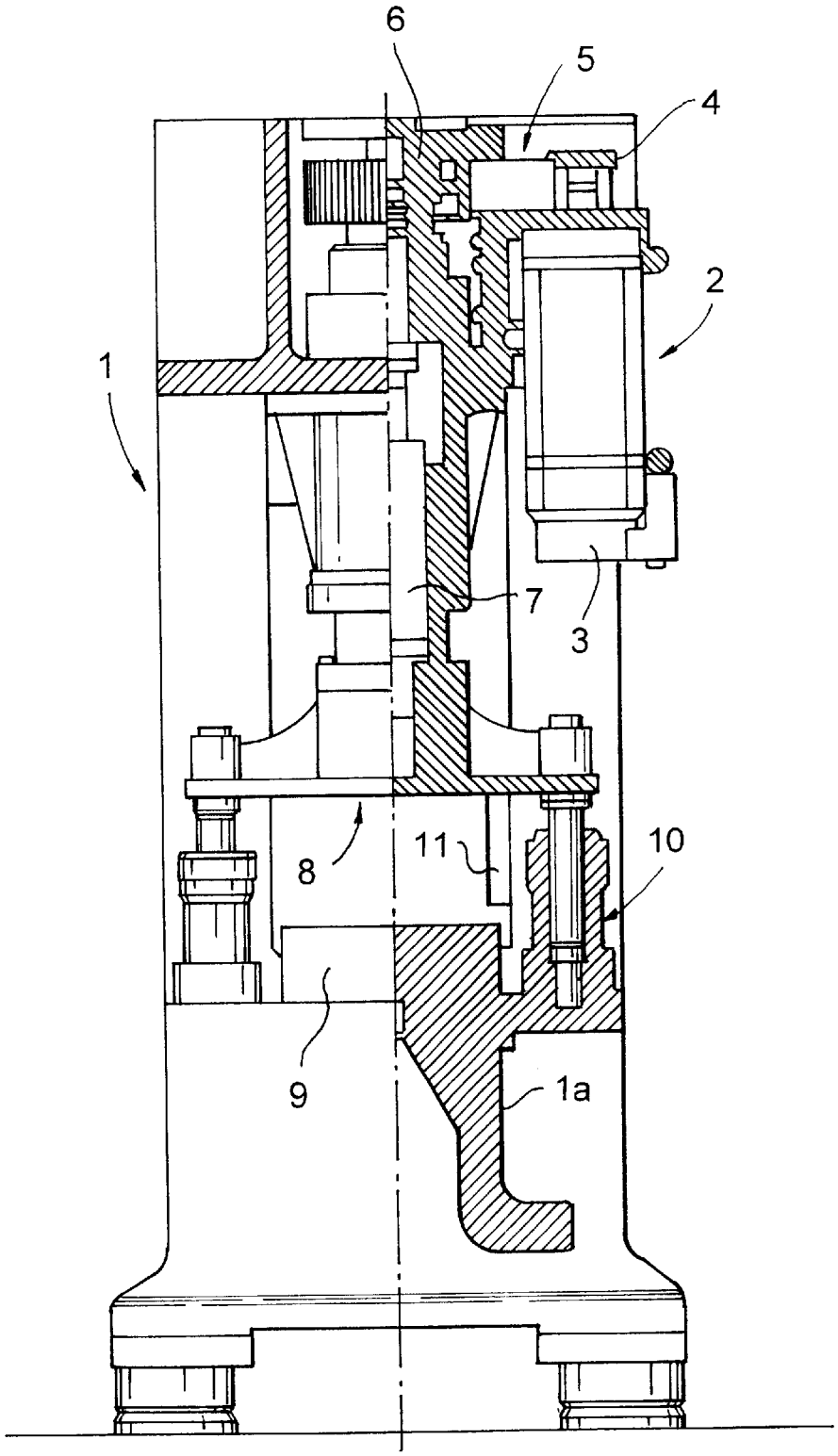
FIG. 1 is a front partly in section of a screw press made in accordance with the invention.

Referring to FIG. 1, a servo motor 2 is affixed to a frame 1. A pulley 4 is affixed to the output shaft of servo motor 2. An encoder 3 is provided on a lower end of servo motor 2. A screw mechanism is provided on frame 1. A pulley 6 is affixed to the top end of the screw shaft. A belt is placed over pulley 4 and pulley 6. The diameter of pulley 4 is smaller than the diameter of pulley 6. The deceleration device is constructed from pulley 4, pulley 6, and belt 5.

The lower end of the above screw shaft is screwed into a nut on a ram 8. Ram 8 is guided by a guide mechanism 10 and can be raised and lowered freely. Guide mechanism 10 comprises a cylindrical guide body affixed to a bed 1*a*, and a solid rod which is affixed to ram 8 and can be inserted into the above cylindrical guide body. Guide mechanism 10 guides ram 8 in the up and down direction. A bolster 9 is affixed to bed 1*a*.

Referring to FIG. 1, a linear scale 11 is installed interposed between either frame 1 or bolster 9 and ram 8. Linear scale 11 measures the vertical position of ram 8. Using the output, the positional control of ram 8, or in other words, the positional control in the vertical direction of ram 8, is conducted. Linear scale 11 is installed in a location which is not easily affected by deformation of frame 1. In other words, by having the position in the height direction near the lower surface of ram 8, and making the distance from the upper surface of bed 1*a* very small, the deformation amount of frame 1 in between them is made small. As the distance from the upper surface of bed 1*a* to linear scale 11 increases, the deformation amount of frame 1 in between them grows larger, and the error in the output of linear scale 11 becomes large.

It is understood that in such operation, an upper die mold die is affixed to the lower surface of ram 8, and a lower mold die is affixed to the upper surface of bolster 9. A die position sensor is provided, this position sensor being located interposed between one of the screw press frame 1 or bolster 9, and the ram 8. This is a high precision sensor which can accurately measure the distance between the upper and lower mold in the vicinity of the bottom dead center. The material supplied between the upper mold and lower mold is press worked in conjunction with the rising and falling motion of ram 8 and becomes the product.

When servo motor 2 rotates, the rotation of servo motor 2 is transferred to the screw shaft of screw mechanism 7 via pulley 4, belt 5, and pulley 6. In this situation, the rotational torque of servo motor 2 is increased and transferred to the screw shaft.

When the screw shaft rotates, ram 8 descends at an established speed due to the action of screw mechanism 7. The material supplied between upper mold and lower mold is press worked. Once ram 8 reaches the bottom dead center, and the press working is completed. Servo motor 2 reverses rotation, and ram 8 rises at the established speed and stops at the top dead center.

Figure 2:
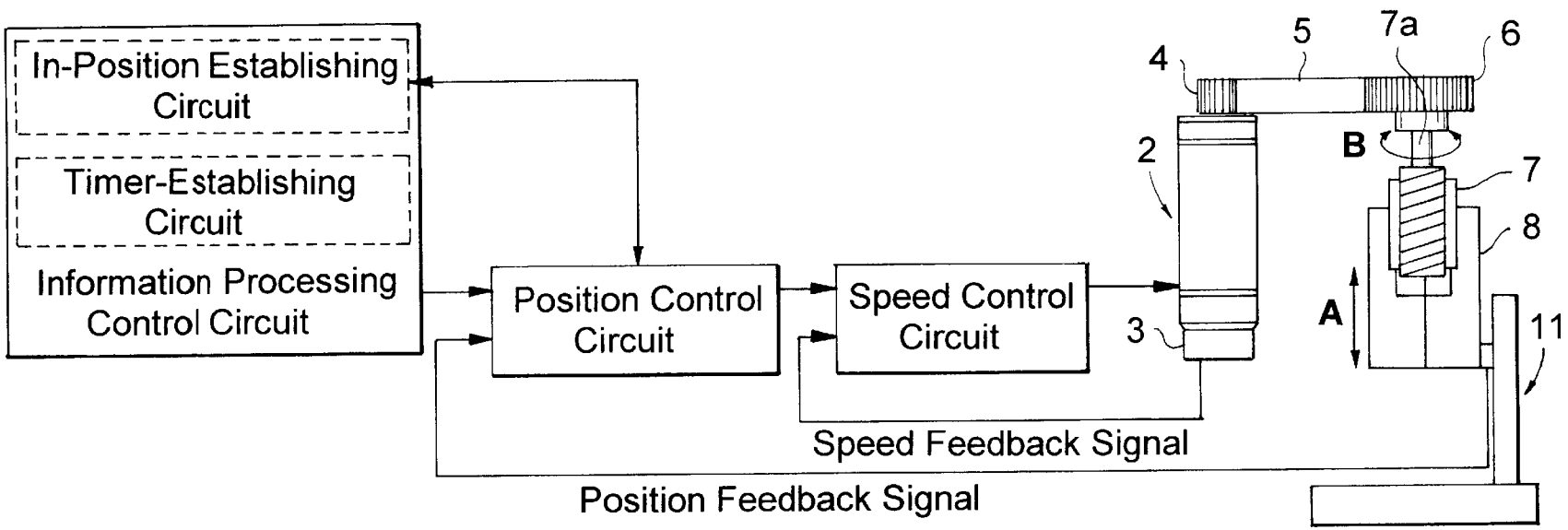
FIG. 2 is a block diagram detailing operation of the screw press.

Referring to FIG. 2, as described above, when servo motor 2 rotates, screw shaft 7*a* rotates in the direction of arrow B, and ram 8 rises and falls in the direction of arrow A. The output of linear scale 11 is fed back to the position control circuit. The pulse signal of encoder 3 is fed back to the speed control circuit. In other words, the positional control of ram 8 is conducted with the output of linear scale 11. The speed control of ram 8 is conducted by the pulse signal of encoder 3.

Referring again to FIG. 2, with the information processing control circuit, processing of data, such as inputting, establishing, changing of data such as the position and speed and the like of the ram is conducted. The information processing control circuit contains an in-position establishing circuit and timer establishing circuit, which are described later.

Figures 3A, 3B, 3C, 3D:
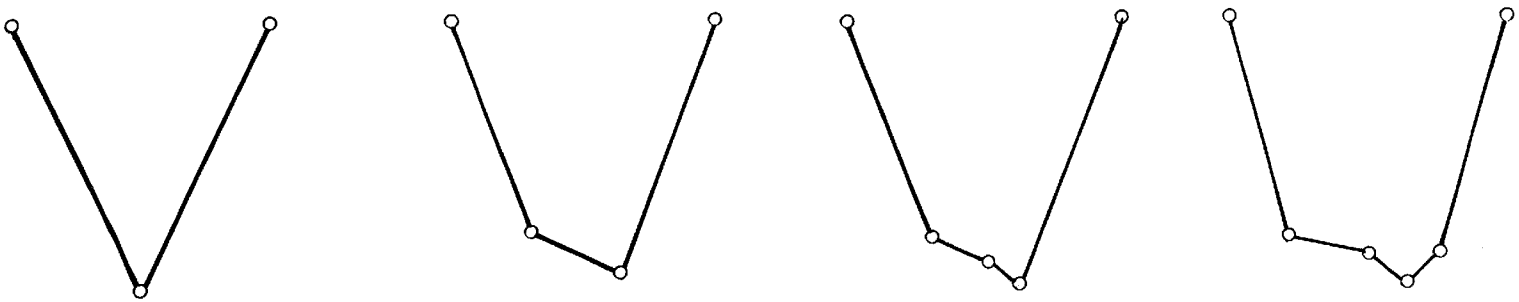
FIGS. 3(*a*)–(*d*) depict various molding patterns.

Referring to FIGS. 3(*a*)–(*d*), the molding patterns, or in other words, the motion patterns for ram 8 needed for various press working, are indicated by (a) two position, (b) three position, (c) four position, (d) five position. Referring to these figs., the vertical axis represents distance in the vertical direction, and the horizontal axis is the time axis. In the situation of the first (a) two position, ram 8 is simply lowered and raised. Both are at constant speeds, and ram 8 simply goes back and forth between the top dead center and the bottom dead center. The vertical distance from the top dead center to the bottom dead center is the stroke length. The slope of the line segment represents the speed of ram 8. These line segments represent the locus of the motion of ram 8.

In the situation of the second (b) three position, ram 8 decelerates part way through the descent. In drawing and punching, there are advantages in terms of moldability, noise and vibration and the like if press working is done while decelerating.

One pattern is selected from among the patterns shown in FIGS. 3(*a*)–(*d*) depending on the press working. Afterwards, the position and speed of each position is inputted and established.

Figure 4:
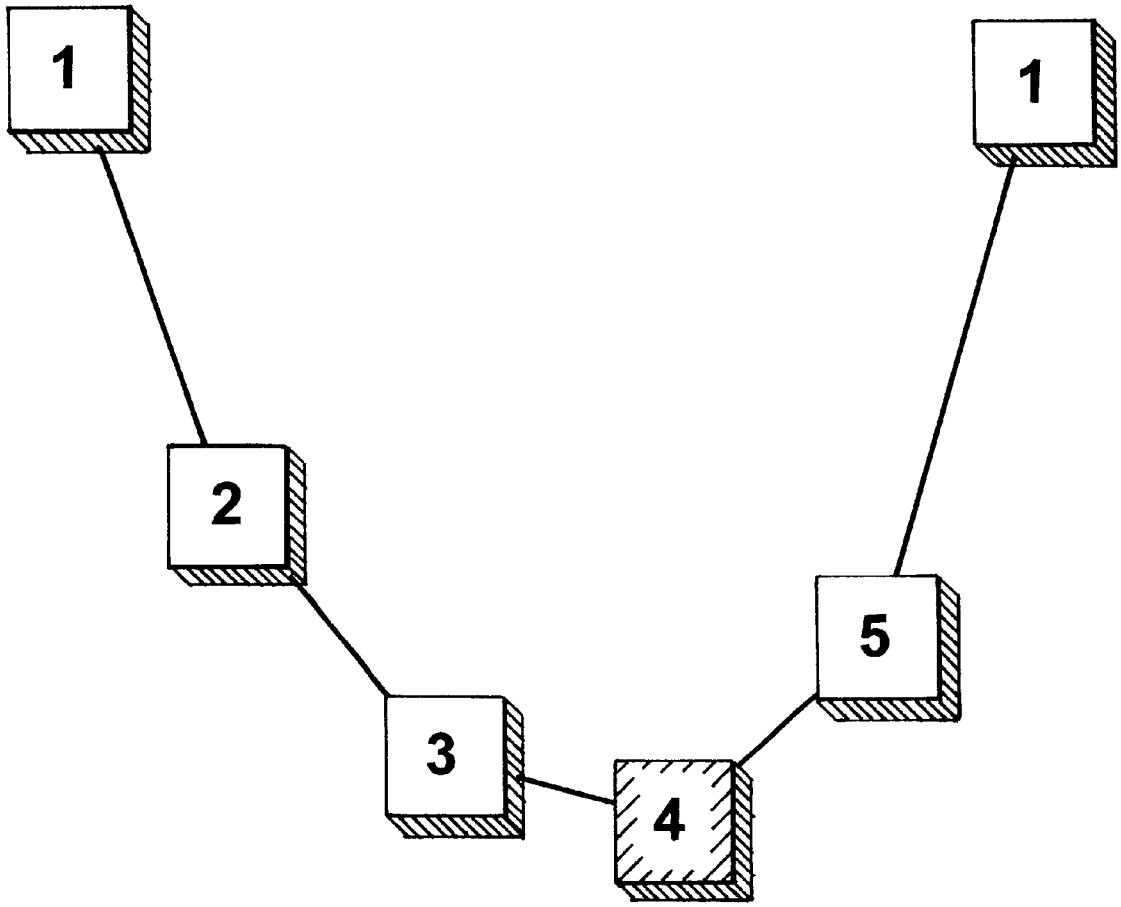
FIG. 4 is a descriptive drawing of the positional setting.
Figure 5:
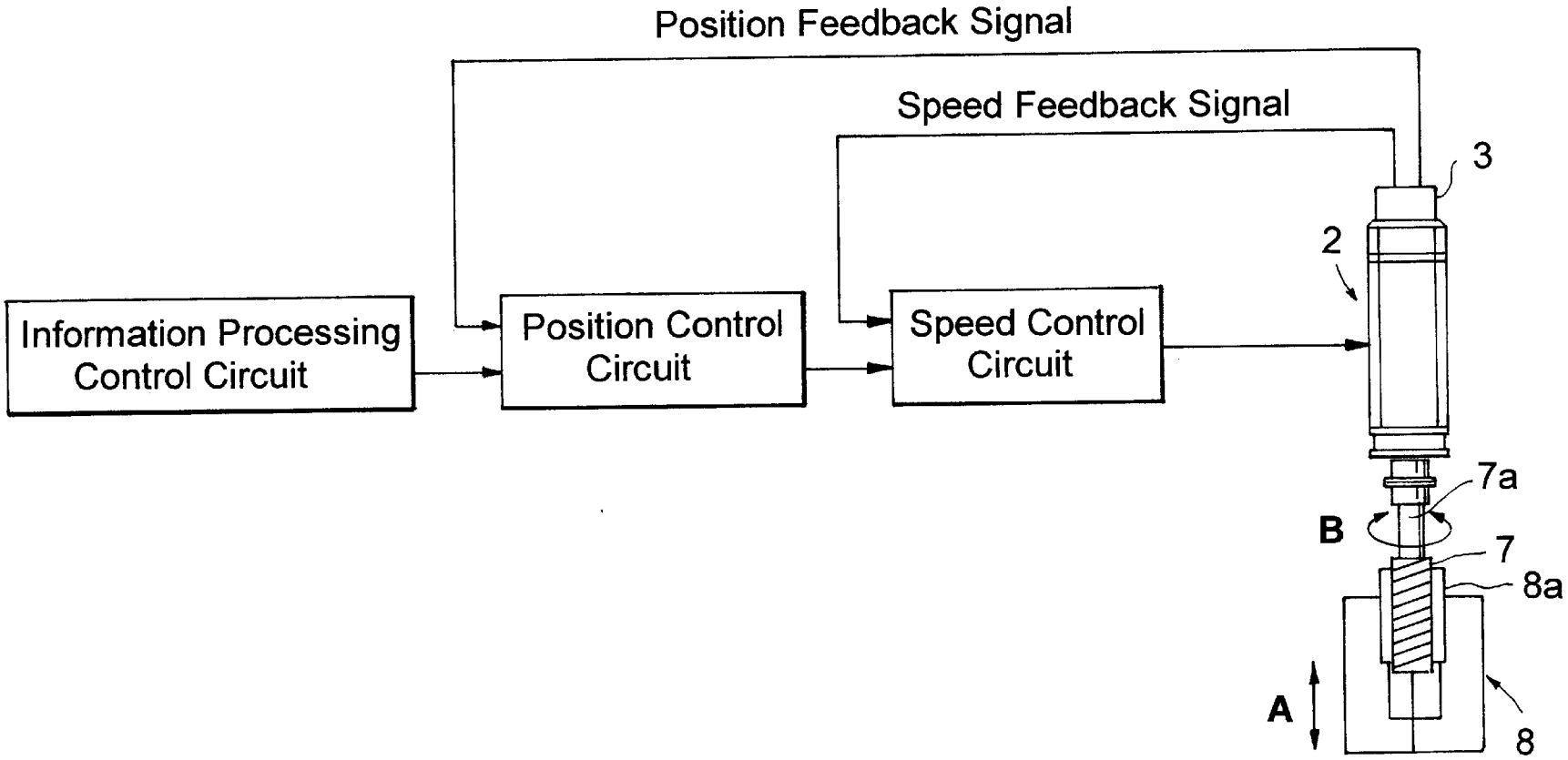
FIG. 5 (Prior Art)
FIG. 5 is a block diagram of a prior art screw press.

Referring to FIG. 4, the steps for establishing the position and speed of ram 8 when the five position, FIG. 3(*d*), is selected is described. First, the bottom dead center must be determined. In this example, the fourth position is the bottom dead center. Next, the stroke length, or in other words the vertical distance between the first position and the fourth position, is established. The location of each position, or in other words the height from the bottom dead center, is established. Next, the speed between each of the positions is established. In this manner, the motion pattern of ram 8 is established. Furthermore, the above settings are conducted by keying in the values at sites on the control board determined for each item.

The position of ram 8 is controlled by matching the position data established in the above manner with the output from linear scale 11. The speed of ram 8 is controlled by matching the speed data established in the above manner with the output from encoder 3.

Below, the series of motions of the ram is described. Referring to FIG. 4, when the press machine is not operating, servo motor 2 is stopped, and ram 8 is stopped at the first position, which is the top dead center. When the operation of the press machine is started, servo motor 2 has a positive rotation, and ram 8 descends at the established speed from the first position to the second position. When ram 8 reaches the second position, it descends towards the third position at the established speed.

Similarly, when ram 8 reaches the fourth position, which is the bottom dead center, servo motor 2 reverses rotation, and ram 8 rises towards the fifth position at the established speed. Similarly, ram 8, which has reached the fifth position, returns to the top dead center, and servo motor 2 stops, and ram 8 also stops. The above series of motions is repeated. When operating the press machine continuously, servo motor 2 switches to the positive rotation at the top dead center, ram 8 descends after reaching the top dead center, and the same motions as described above is repeated.

With the above motions, if at the fourth position, the position of ram 8 is attempted to be made infinitely closer to the established value, an extraordinary amount of time is needed for controlling this, and productivity is reduced. Depending on the allowable precision of the product to be handled, when the difference between the established value and the current position of ram 8 reaches within a constant value (henceforth referred to as in-position value, and refer to in-position establishing circuit of FIG. 2), it is considered to have reached the established position, and the motion of ram 8 goes on to the next step. As an example of the above described in-position value, it is set as plus or minus 5 micrometers from the aforementioned established value. This in-position value is designed to be able to be established within a range of 1 micrometers to 1000 micrometers. As described previously, the in-position value is selected according to the allowable precision of the product to be handled. The in-position value can be corrected by measuring the dimensions of an actual product which has been press worked.

In the above series of motions, for example, because there is variability for the control in the actual locus of ram 8 in the second position, the locus of ram 8 does not pass directly over the second position, but passes along a curve in the vicinity of the second position. In other words, in the vicinity of the intersection between the straight line connecting the first position and second position and the straight line connecting the second position and the third position, the locus becomes a curve of a certain radius.

In the press working, there are situations where the second position is very important and the above radius is preferably as small as possible, and there are also situations where the second position is not very important, and the above radius can be large. Therefore, it is preferable that the above radius is not constant and can be established and changed according to the situation.

In the present invention, the position passage precision is determined by establishing or modifying the aforementioned variability using a timer establishing circuit shown in FIG. 2 for each position. In other words, for each of the above positions, the stopping time is established by a timer, and the locus of ram 8 is controlled so that it has the desired position passage precision. This established value can be amended based on press working conditions and the precision of the press worked product.

As a means for improving the position passage precision for each of the above positions, other than using a timer as described above, an in-position method as described previously can be used. In other words, for each position, an in-position value is established, and when the position of ram 8 is within the in-position value, it advances to the next step.

Next, some measurement results from the inventors regarding the positional precision of the ram will be introduced. With a machine capable of being pressurized to 600 kN, when there is a 400 kN load, the error at the bottom dead center when using a linear scale is a few micrometers to ten and some micrometers. When a linear scale is not used and it is controlled by an encoder, the error is several hundreds of micrometers.

The above error is the difference between the value established beforehand and the actual value measured at the bottom dead center position. By this experiment, it can be seen that with the present invention, a ram positional precision of approximately 10 times or more from the prior art is achieved. In other words, a high precision press working product can be achieved.

The present invention uses a control system (full-closed loop system) in which the ram position is directly measured and its output is fed back to the position control device. As a result, it can conduct positional control of the ram with extremely high precision. In other words, the ram position can be controlled with high precision without any influence from the extension of the frame due to a load, the deformation of parts due to thermal changes, deformation and looseness between parts due to a load, which is transferred from the power of the servo motor, on the parts.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a screw press, in which a ram is driven in upward and downward movements by a screw mechanism, the screw mechanism being operated by the output of a servo motor, wherein:

a position detection sensor which detects a position of the ram, is interposed between one of a screw press frame or a bolster, and said ram;

an output of said position detection sensor being used in controlling a position of said ram;

a locating in the vertical direction of said position detection sensor being proximal a lower surface of said ram, wherein a value of a ram bottom dead center is pre-established, and an in-position value in which said ram is considered to have reached said bottom dead center position is provided, and said in-position value selectively is adjustable.

2. A screw press as described in claim 1, wherein:

a vicinity of a plurality of points specifying ram positions are preselected, a variability for control can be adjusted by a timer for each of said plurality of points, wherein for each of the points, the stopping time is established by the timer and a locus of the ram is controlled so that it has a desired position passage precision.

3. A screw press as described in claim 2, wherein:

for each point other than a ram bottom dead center, there are in-position values, in which said ram is considered to have reached each of said plurality of points, and each said allowable value can be adjusted freely.

* * * * *

UNITED STATES PATENT AND TRADEMARK OFFICE

CERTIFICATE OF CORRECTION

PATENT NO. : 6,520,077 B1 
DATED : February 18, 2003
INVENTOR(S) : Takaki Minagawa et al.

It is certified that error appears in the above-identified patent and that said Letters Patent is hereby corrected as shown below:

Title page,
Item [30], Foreign Application Priority Data:
Reference 2, delete "March 31, 2000" and substitute with -- March 31, 1999 --
Reference 3, delete "June 24, 2000" and substitute with -- June 24, 1999 --

Signed and Sealed this

Second Day of September, 2003

JAMES E. ROGAN
*Director of the United States Patent and Trademark Office*